United States Patent [19]

Shibanaka

[11] Patent Number: 4,961,567

[45] Date of Patent: Oct. 9, 1990

[54] SORTING APPARATUS

[75] Inventor: Mitsugu Shibanaka, Sakai, Japan

[73] Assignee: Mita Industrial Co. Ltd., Osaka, Japan

[21] Appl. No.: 319,682

[22] Filed: Mar. 7, 1989

[30] Foreign Application Priority Data

Mar. 14, 1988 [JP] Japan ..... 63-59646

[51] Int. Cl.[5] ..... B65H 39/10

[52] U.S. Cl. ..... 271/293; 271/176

[58] Field of Search ..... 271/176, 298, 288, 289, 271/290, 292, 293

[56] References Cited

U.S. PATENT DOCUMENTS 4,114,871 9/1978 Botte ..... 271/290

4,318,542 3/1982 Altmann ..... 271/290

*Primary Examiner*—Richard A. Schacher

*Attorney, Agent, or Firm*—Beveridge, DeGrandi & Weilacher

[57] ABSTRACT

The sorting apparatus detects time intervals between copy papers, detects exchange of a first manuscript to a second manuscript, thereby to memorize a sorting number, and sorts the copy papers with regard to the second and subsequent manuscripts on the basis of said sorting number.

2 Claims, 5 Drawing Sheets

SORTING APPARATUS

BACKGROUND OF THE INVENTION

1. Field of the Invention

The present invention relates to a sorting apparatus for sorting copy papers discharged from an image forming apparatus of a copying machine, a printing machine and so on, the sorting apparatus detecting exchange of a manuscript on the basic of discharge time interval of the copy papers.

2. Description of the Related Art

Hitherto, in an off-line type sorting apparatus, to which signals of the copying machine are not supplied, the copying machine copies and discharges the copy papers to the sorting apparatus at time intervals as shown in FIG. 1.

That is, FIG. 1 shows such case that 5 pieces of copy papers are sorted for a first manuscript and the first manuscript is exchanged, and further 5 pieces of copy papers are sorted for a second manuscript.

In FIG. 1, $T_1$ indicates the discharge time interval of the sorted copy papers for the first manuscript. $T_2$ indicates the exchange time interval of the first manuscript to the second manuscript. $T_3$ indicates the discharge time interval of the sorted copy papers for the secnd manuscript. Then as shown in FIG. 1, the time interval $T_2$ is designed to be larger than the time intervals $T_1$, $T_3$ so that the sorting apparatus can detect the manuscript exchange.

Thus the sorting apparatus detects the number of the sorting copy papers for one manuscript (hereinafter abbreviated as sorting number) on the basis of time interval $T_2$ and memorizes the sorting number and further sorts for subsequent (second, third, . . . ) manuscript by utilizing the sorting number. However, the sorting apparatus is designed in a manner that even after the sorting number is detected and memorized by utilizing the first manuscript, and even when the sorting is executed for the second manuscript and after, the manuscript exchange time interval $T_2$ is designed to be larger than the time intervals $T_1$, $T_3$ by the copying machine, and thereby the subsequent manuscript exchange is detected by the sorting apparatus by both the sorting number and the time interval $T_2$.

The reason why the manuscript exchange time interval $T_2$ is designed to be larger than the time intervals $T_1$, $T_3$ for the subsequent manuscript is discussed below.

On occasion, the copying machine happens to copy papers of over the memorized number for the same one manuscript with regard to the subsequent manuscript. In such a case, the sorting apparatus should consider the case as an sorting-over-error and should discharge the superfluous copy papers into a lowest bin tray. This is the above-mentioned reason.

In other words, with regard to the sorting of the subsequent manuscript, when the manuscript exchange time interval $T_2$ is not larger than the time intervals $T_1$, $T_3$, the sorting apparatus cannot detect the sorting-over-error.

However, in such conventional sorting apparatuses, total copying operation time of the copying machine is long, since the manuscript exchange time intervals $T_2$ of the subsequent manuscript is larger than the time intervals $T_1$, $T_3$.

SUMMARY OF THE INVENTION

An object of the present invention is to provide a sorting apparatus of a copying apparatus capable of copying at a high speed.

A sorting apparatus of the present invention comprises;

a sorting means for sorting one by one image media discharge from an image forming apparatus, a paper sensor for detecting the discharged image media, a time interval detecting means for detecting each time interval at least between image media of a first manuscript and between a first manuscript and a second manuscript on the basis of the output of the paper sensor, a manuscript exchange detecting means for detecting exchange of a first manuscript of the image forming apparatus on the basis of the time interval detected by the time interval detecting means, a sorting number detecting means for detecting a sorting number on the basis of both the detected exchange of the manuscript and the output of the paper sensor, a memorizing means for memorizing the detected sorting number, and a sorting instructing means for instructing the sorting means to sort the image media with regard to the second and subsequent manuscripts on the basis of the memorized sorting number.

An image forming machine of the present invention comprises;

an image forming apparatus for forming image media and discharging them at a large time interval ($T_2$) for exchange of a first manuscript, and at a short time interval ($T_0$) for exchange of subsequent manuscripts, the large time interval being larger than the time interval between the image media and the short time interval being nearly equal to the time interval between the image media, a sorting means for sorting one by one image media discharged from the image forming apparatus, a paper sensor for detecting the discharged image media, a time interval detecting means for detecting each time interval at least between image media of a first manuscript and between a first manuscript and a second manuscript on the basis of the output of the paper sensor, a manuscript exchange detecting means for detecting exchange of a first manuscript of the image forming apparatus on the basis of the time interval detected by the time interval detecting means, a sorting number detecting means for detecting a sorting number on the basis of both the detected exchange of the manuscript and the output of the paper sensor, a memorizing means for memorizing the detected sorting number, and a sorting instructing means for instructing the sorting means to sort the image media with regard to the second and subsequent manuscripts on the basis of the memorized sorting number.

DESCRIPTION OF THE PREFERRED EMBODIMENTS

The present invention is described further with reference to the drawings which show the embodiments thereof.

Figure 1:
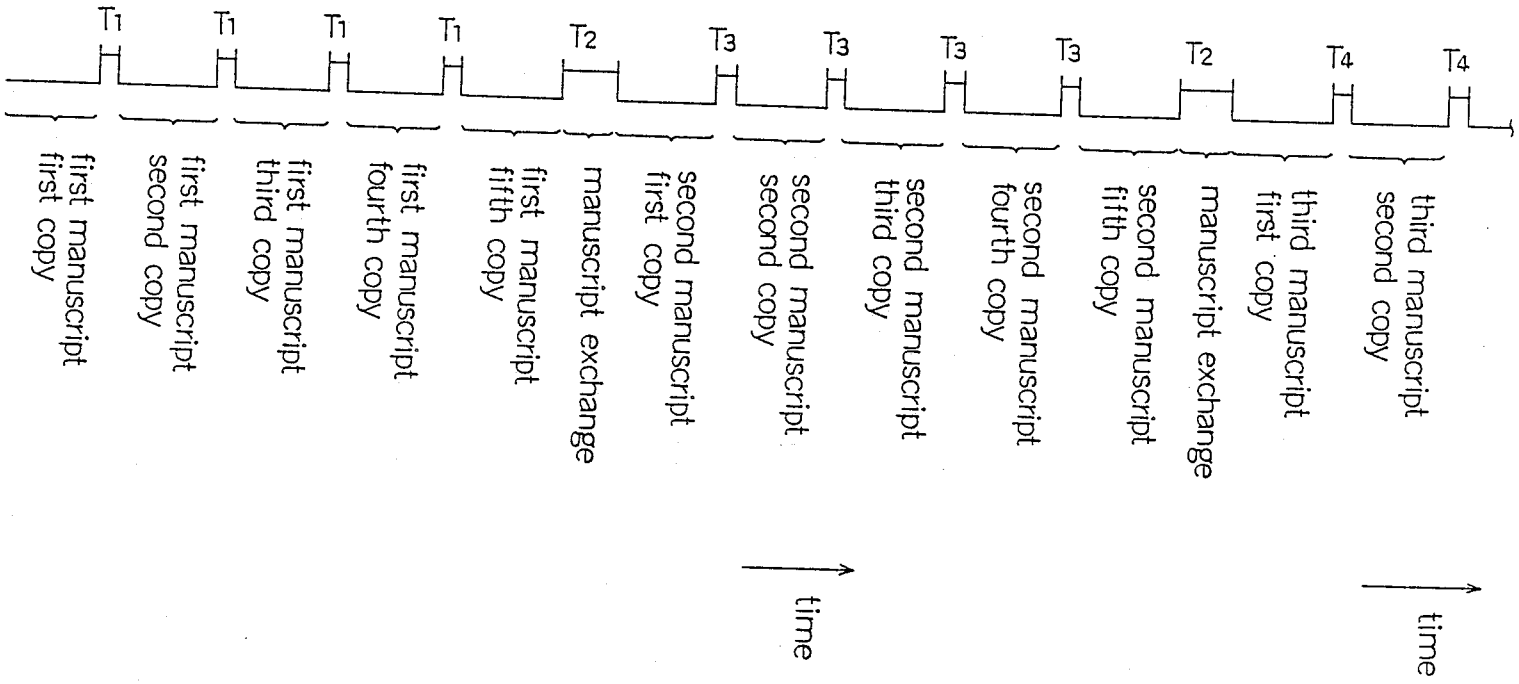
FIG.1 ( PRIOR ART )
FIG. 1 is a timing chart showing a discharge time interval of copy papers of a conventional copying machine.
Figure 2:
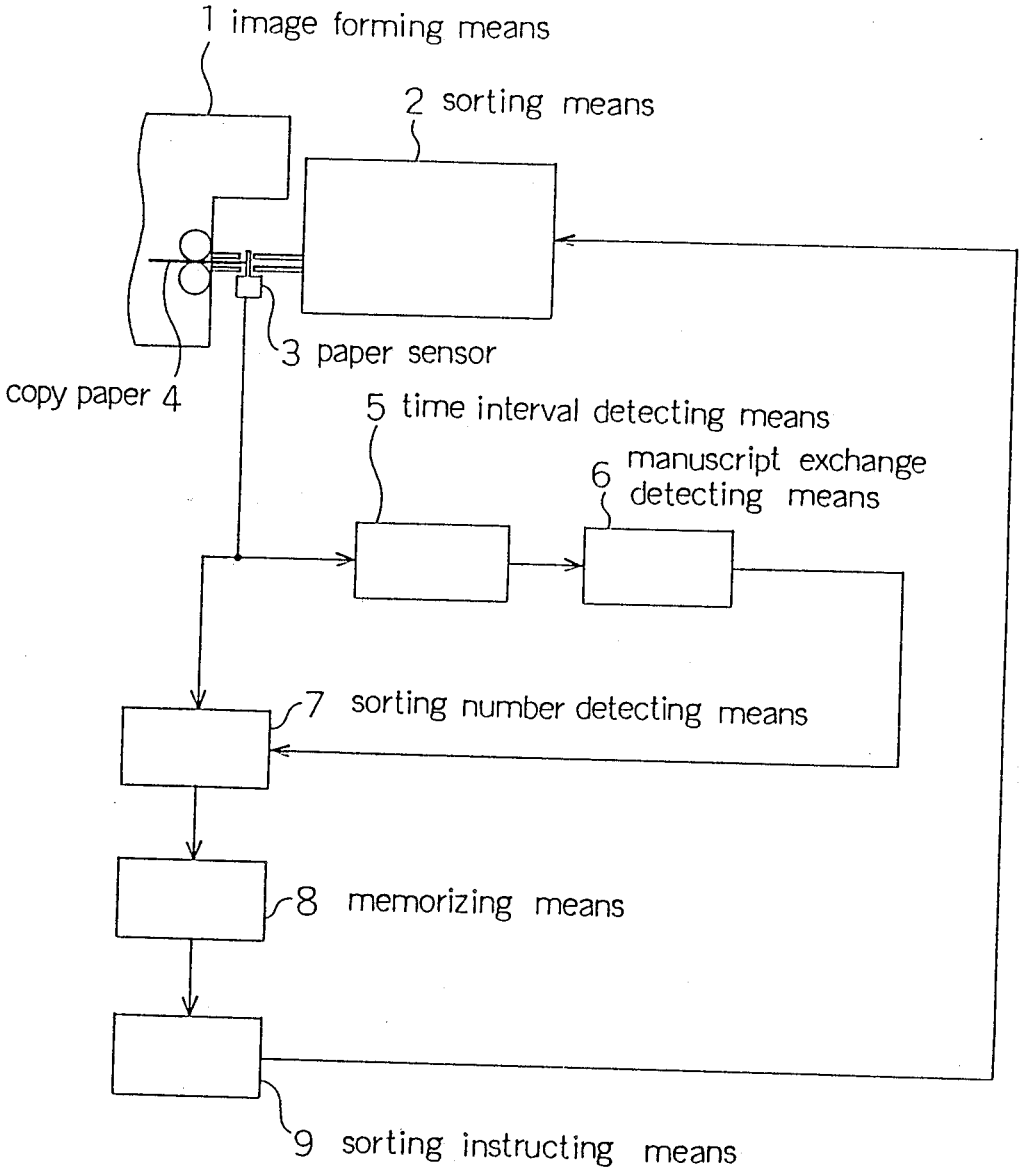
FIG. 2 is a block diagram showing an embodiment of a sorting apparatus according to the present invention.

FIG. 2 is a block diagram showing an embodiment of the sorting apparatus according to the present invention. An image forming apparatus 1, for example, copying machine or printing apparatus, is such an apparatus for copying a manuscript onto paper 4. A sorting means 2 is a mechanism of the sorting apparatus, for taking in the copy paper 4 discharged from the image forming apparatus 1 and for sorting the copy papers 4. A paper sensor 3 is a device, for example, a conventional touch-type or an optical-type sensor, for detecting the transferring of the copy paper 4 from the image forming apparatus 1 to the soring means 2.

A time interval detecting means 5 is means for detecting time interval $T_1$, $T_2$, $T_3$, . . . between the successively transferred copy papers 4 on the basis of an output signal of the paper sensor 3. The time interval $T_1$, $T_2$, $T_3$, . . . is detected on the basis of the timing when the paper sensor 3 detects a front edge of the paper 4 or the timing when the paper sensor 3 detects a rear edge of the paper 4. Or the time interval $T_1$, $T_2$, $T_3$, . . . is detected on the basis of a time interval between the timing of the detecting of the rear edge of a former paper 4 and the timing of the detecting of the front edge of a later paper 4.

Figure 5:
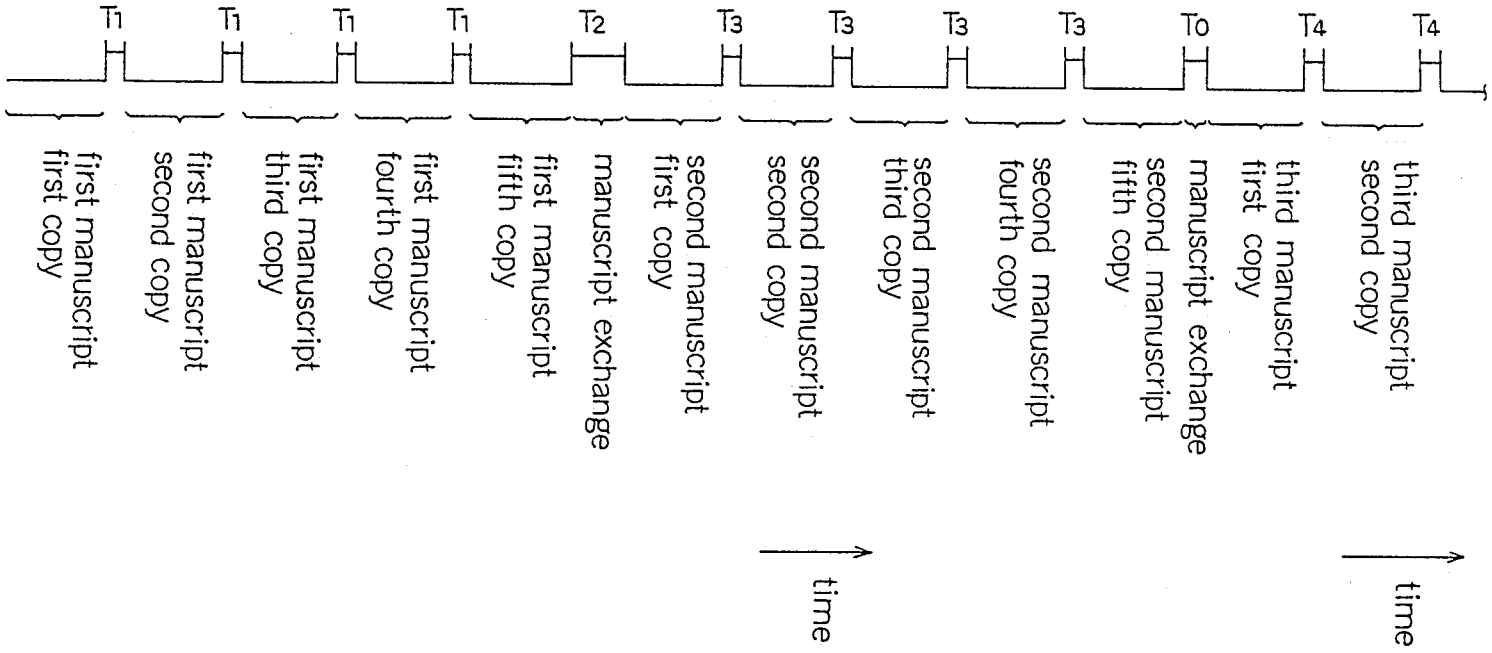
FIG. 5 is a timing chart showing a discharge time interval of copy papers of a copying machine of the embodiment of the sorting apparatus according to the present invention.

A manuscript exchange detecting means 6 is means for detecting exchange of the manuscript in the image forming apparatus 1 on the basis of the time interval $T_1$, $T_2$, $T_3$, . . . detected by the time interval detecting means 5. That is, as shown in FIG. 5, when the first manuscript is copied, the time interval $T_1$ is relatively short. On the contrary, when the first manuscript is exchanged to second manuscript, the time interval $T_2$ is larger than the time interval $T_1$. Therefore, the manuscript exchange can be detected by comparing the time interval $T_1$, $T_2$. The image forming apparatus 1 copies and discharges the copy paper at such time interval $T_1$, $T_2$. For realizing such time interval $T_1$, $T_2$, for example, the image forming apparatus 1 has such sort key that the image forming apparatus 1 makes distinction between the first manuscript and the second and after manuscripts by the sort key operation. Or such image forming apparatus 1 having a manuscript automatic feeding device, can make distinction between the first manuscript and the second and after manuscripts by using signals from the manuscript automatic feeding device, thereby realizing the time interval $T_1$, $T_2$.

A sorting number detecting means 7 is means for detecting sorting number of copy papers on the basis of both the manuscript exchange detected by the manuscript exchange detecting means 6 and the output signal of the paper sensor 3. That is, utilizing the output signal of the paper sensor 3, the sorting number detecting means 7 starts to count the copy paper pieces when the first copy paper 4 is discharged, and issues the counted number as the sorting number when the manuscript exchange is detected by the manuscript exchange detecting means 6. FIG. 5 shows such embodiments wherein the soring number is 5.

A memorizing means 8 is means, for example, RAM (random access memory) for memorizing the sorting number detected by the sorting number detecting means 7.

A sorting instructing means 9 is means for instructing the sorting means 2 to sort the discharged copy papers with the sorting number memorized on the memorizing means 8 with regard to the second and after manuscripts. Then the sorting means 2 sorts the subsequent copy papers on the basis of the sorting number regardless of the time interval length. The image forming apparatus 1 copies and discharges the copy papers at such short time intervals of $T_3$, $T_0$, $T_4$, . . . .

Figure 3:
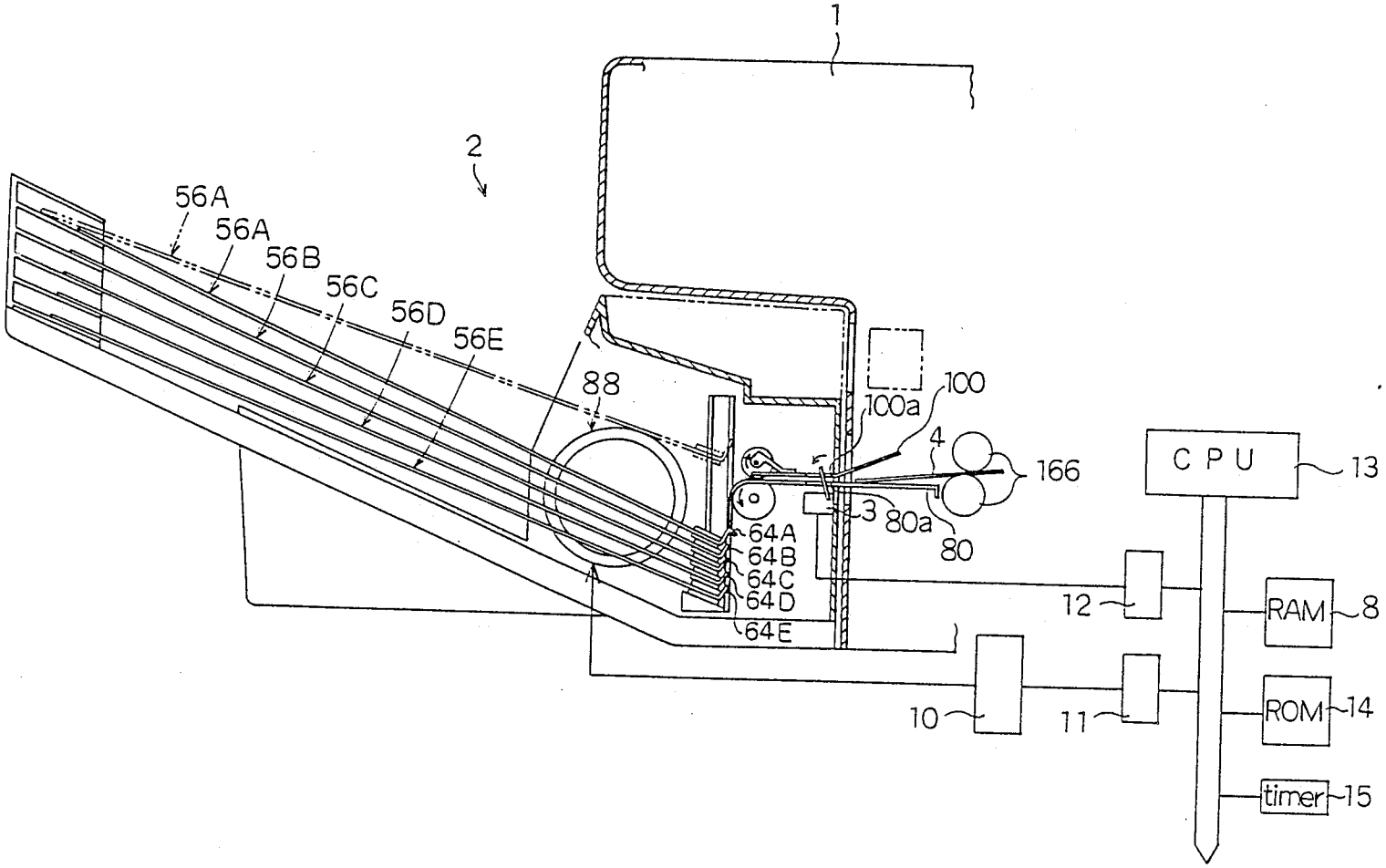
FIG. 3 is a side sectional view showing another embodiment of the sorting apparatus according to the present invention.
Figure 4:
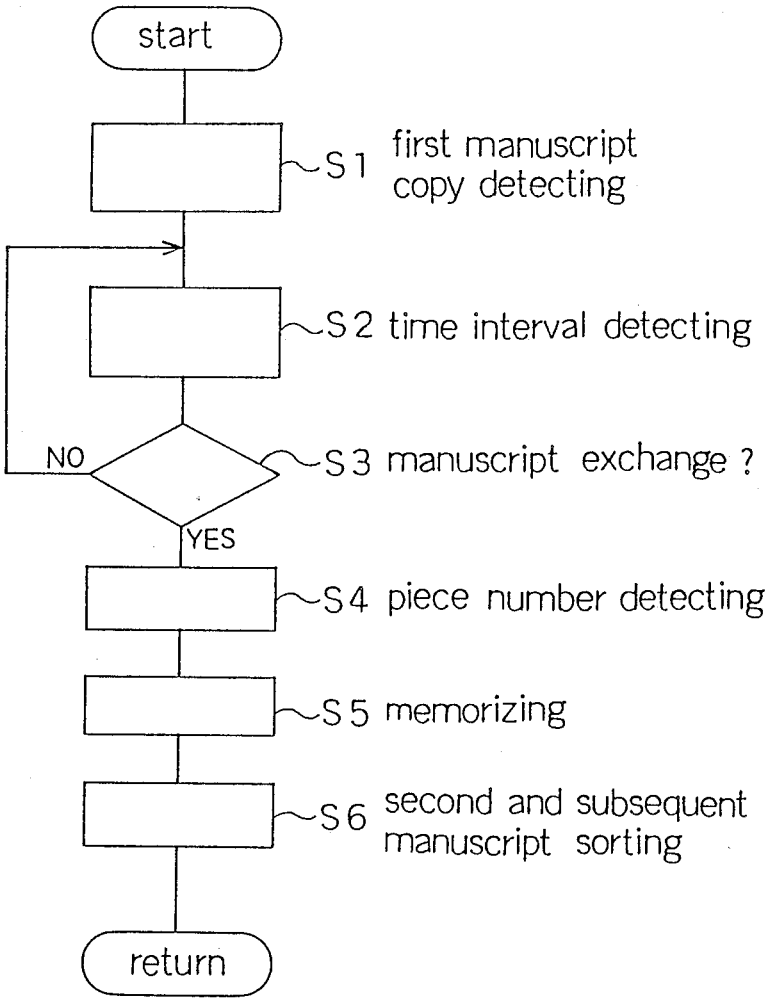
FIG. 4 is a flow chart showing the operation of the embodiment of the sorting apparatus according to the present invention.

FIG. 3 is a side sectional veiw showing an embodiment of the sorting apparatus utilizing the micro-computer according to the present invention.

The image forming apparatus 1 has a discharging roller 166 built-in for discharging the copy paper 4. Near the discharging roller 166, upper stream (which is judged on the basis of the flow of the copy paper 4) parts of an upper guide 100 and an under guide 80 are disposed forming a gap. The down stream parts of the upper guide 100 and under guide 80 fronts on upper stream edges of bin trays 56A~56E.

The central part of the upper guide 100 is cut through forming hole **100*a* and the central part of the under guide 80 is cut through forming hole 80*a* which is facing the hole 100*a*. A pin of the paper sensor 3 passes upward through the holes 100*a*, 80*a*. When the copy paper 4 transfers between the upper guide 100 and the under guide 80, the copy paper 4 runs against the pin, thereby to drive an optical switch of the paper sensor 3. Therefore, the paper sensor 3 can count the number of times of transferring of the copy papers 4**.

The upstream-side edges 64A~64E of the bin trays 56A~56E go up and go down one by one in order as shown by two dots chain line. As the upstream-side edges 64A~64E go up and down in order, a large space is produced in order at the upstream-side of the bin trays 56A~56E, thereby to respectively take in the copy paper 4 discharged from the image forming apparatus 1.

A cam member 88 is means for making the bin trays 56A~56E go downward and go upward in order. That is, the cam member 88 is rotated by a bin tray drive means 10, thereby to make the bin trays 56A~56E go upward in the order of the bin tray 56A, the bin tray 56B, the bin tray 56C, the bin tray 56D and the bin tray 56E, and to make the bin trays 56A~56E go downward in the order of the bin tray 56E, the bin tray 56D, the bin tray 56C, the bin tray 56B and the bin tray 56A, (see Japanese patent appl. No. sho 62-300,077).

The bin tray drive means 10 is connected to a CPU (central processing unit) 13 through an interface 11.

The paper sensor 3 is connected to the CPU 13 through an interface 12. A timer 15 is a time counter.

The CPU 13 is means for realizing these functions of the time interval detecting means 5, the manuscript exchange detecting means 6, the sorting number detecting means 7, the sorting instructing means 9 and so on, by utilizing the RAM means 8, the timer 15 and so on. A ROM means 14 is a read-only memory memorizing such computer program to realize the above-mentioned functions of the CPU 13.

Then, the operation of the above-mentioned embodiments is described referring to the flowchart of FIG. 3.

First, the first manuscript is set on a manuscript set plate of the image forming apparatus 1 and the sorting number, for example, 5 is set by ten key etc. Next, a first copy paper 4 is discharged from the discharge roller 166 and is supplied to the gap of the upper guide 100 and the under guide 80 when a copy start key is pressed. The paper sensor 3 detects the first copy paper 4, when the copy paper 4 is passed through the gap (step S1). The copy paper 4 is discharged on the bin tray 56A from the downstream edge of the guides 80, 100.

The image forming apparatus 1 and the sorting apparatus are off-line type, and therefore the image forming apparatus 1 discharges the remaining copy papers of 4 pieces in order regardless of the operation of the sorting apparatus 1. The sorting means 2 sorts the remaining copy papers 4 to the bin trays 56B~56E until the manuscript is exchanged. When the copy of the first manuscript is finished, the first manuscript is exchanged to a second manuscript and the image forming apparatus 1 copies the second manuscript.

The time interval detecting means 5 detects the time interval (as shown in FIG. 5) between the discharged copy papers 4 by the output signal of the paper sensor 3 (step S2).

The manuscript exchange detecting means 6 knows the exchange by detecting the large time interval $T_2$ corresponding to the first manuscript exchange by comparing the time intervals detected by the time interval detecting means 5 (step S3).

Then the sorting number detecting means 7 counts the piece number of the discharged copy papers 4 on the basis of the output of the paper sensor 3 and knows the manuscript exchange by the output of the manuscript exchange detecting means 6, and thereby to detect the copy number (5 pieces) of the first manuscript, namely, the sorting number (step S4). The memorizing means 8 memorizes the sorting number (step S5). Then the sorting number detecting means 7 resets the counted value to 0.

The sorting instructing means 9 instructs the bin tray drive means 10 of the sorting means 2 to sort according to the sorting number (5 pieces) memorized in the memorizing means 8 (step S6). The sorting means 2 sorts the subsequent copy papers of the second, third, fourth, . . . manuscripts on the basis of the sorting number (5 pieces) to the bin trays 56A~56E.

Thus the sorting apparatus of the present invention sorts the copy papers for the second manuscript and after by utilizing the sorting number, and therefore the image forming apparatus 1 does not need the large time interval for informing the manuscript exchange for the second manuscript and after (see the short time interval $T_0$ of FIG. 5). As a result, the total copy operation time can be shortened by utilizing the sorting apparatus of the image forming apparatus and the present invention.

Further the sorting apparatus of the present invention can be applied to not only the sorting means having the movable bin trays but also the sorting means having fixed bin trays.

It is further understood by those skilled in the art that the foregoing description is a preferred embodiment and that various changes and modifications may be made in the invention without departing from the spirit and scope thereof.

I claim:

1. A sorting apparatus comprising;

a sorting means for sorting one by one image media discharged from an image forming apparatus, a paper sensor for detecting said discharged image media, a time interval detecting means for detecting each time interval at least between image media of a first manuscript and between a first manuscript and a second manuscript on the basis of the output of said paper sensor, a manuscript exchange detecting means for detecting exchange of a first manuscript of said image forming apparatus on the basis of the time interval detected by said time interval detecting means, a sorting number detecting means for detecting a sorting number on the basis of both said detected exchange of the manuscript and the output of said paper sensor, a memorizing means for memorizing the detected sorting number, and a sorting instructing means for instructing said sorting means to sort the image media with regard to the second and subsequent manuscripts on the basis of said memorized sorting number.

2. An image forming machine comprising;

an image forming apparatus for forming image media and discharging them at a large time interval ($T_2$) for exchange of a first manuscript, and at a short time interval ($T_0$) for exchange of subsequent manuscripts, said large time interval being larger than the time interval between said image media and said short time interval being nearly equal to the time interval between said image media, a sorting means for sorting one by one image media discharged from said image forming apparatus, a paper sensor for detecting said discharged image media, a time interval detecting means for detecting each time interval at least between image media of a first manuscript and between a first manuscript and a second manuscript on the basis of the output of said paper sensor, a manuscript exchange detecting means for detecting exchange of a first manuscript of said image forming apparatus on the basis of the time interval detected by said time interval detecting means, a sorting number detecting means for detecting a sorting number on the basis of both said detected exchange of the manuscript and the output of said paper sensor, a memorizing means for memorizing the detected sorting number, and a sorting instructing means for instructing said sorting means to sort the image media with regard to the second and subsequent manuscripts on the basis of said memorized sorting number.

* * * * *